US005476403A

United States Patent [19]

Hsia

[11] Patent Number: 5,476,403

[45] Date of Patent: Dec. 19, 1995

[54] ADJUSTABLE SURFBOARD

[76] Inventor: Chin-Yu Hsia, 301 Warren Way, Arcadia, Calif. 91006

[21] Appl. No.: 367,077

[22] Filed: Dec. 30, 1994

[51] Int. Cl.[6] ..... A63C 15/05

[52] U.S. Cl. ..... 441/74; 114/352

[58] Field of Search ..... 441/65, 74, 79; 114/39.2, 352, 354

[56] References Cited

U.S. PATENT DOCUMENTS 3,409,920 11/1968 Brownley ..... 441/74
3,931,655 1/1976 Luscombe ..... 114/352
4,366,769 1/1983 Lingeman ..... 114/352
4,627,372 12/1986 Douglas, III ..... 114/352
4,919,632 4/1990 Smith et al. ..... 114/352

*Primary Examiner*—Stephen Avila
*Attorney, Agent, or Firm*—William W. Haefliger

[57] ABSTRACT

A surfboard, which can be dismantled into sections, for convenient transportation and can be reassembled for use. The surfboard can also be shortened or elongated to provide adequate buoyancy for the convenience of a surfer.

8 Claims, 7 Drawing Sheets

ADJUSTABLE SURFBOARD

BACKGROUND OF THE INVENTION

This invention relates generally to improvements in surfboards. Generally, an ordinary surfboard is bulky and too lengthy to be transported easily by a vehicle. An ordinary surfboard also has a fixed length, which may only be adequate for a particular weight surfer.

There is need for improvements that will enable a surfboard to be dismantled, for easy transportation, and which will also permit the surfboard to be reassembled quickly and easily. In particular, there is need for a surfboard that can be shortened or elongated for the convenience of a surfer.

SUMMARY OF THE INVENTION

Basically, the apparatus of the invention comprises a sectional surfboard wherein a number of sections can be selectively interconnected.

As will be seen, the sequential sections typically have substantially flush upper surface and substantially flush lower surfaces, and the attachment means is confined between the levels of the upper and lower surfaces.

It is a further object of the invention to provide attachment means that includes a) connecting structure penetrating longitudinally into the sequential sections and including loops at the split or splits between sections, and b) a connection pin inserted laterally through the loops at the split, the pin being withdrawable laterally from the loops.

Another object includes provision of connecting structure that includes anchors penetrating longitudinally into the sequential sections, each anchor integral with a loop. The pin typically extends laterally between opposite edges of the board and is releasably connected to the board, whereby the board sections have abutting surfaces at the split. Four such sections may be provided, with pinned interconnections at the junctions of pairs of the sections.

A surfer can adjust the numbers of the middle sections of the surfboard, so that it will provide the most favorable buoyancy for the surfer. When not in use, the surfboard can easily be dismantled back into short, separate sections, for easy transportation.

These and other objects and advantages of the invention, as well as the details of an illustrative embodiment, will be more fully understood from the following specification and drawings, in which:

DRAWING DESCRIPTION

DETAILED DESCRIPTION

Figure 1:
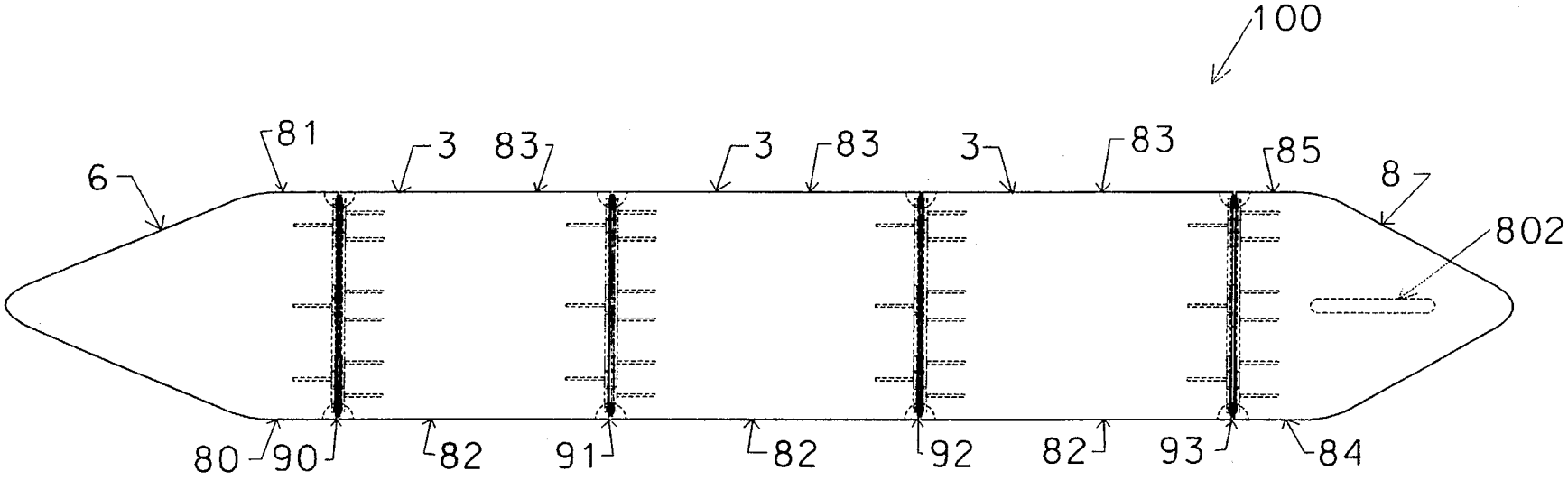
FIGS. 1 and 2 are plan views and elevational views, respectively, of the improved surfboard.
Figure 2:
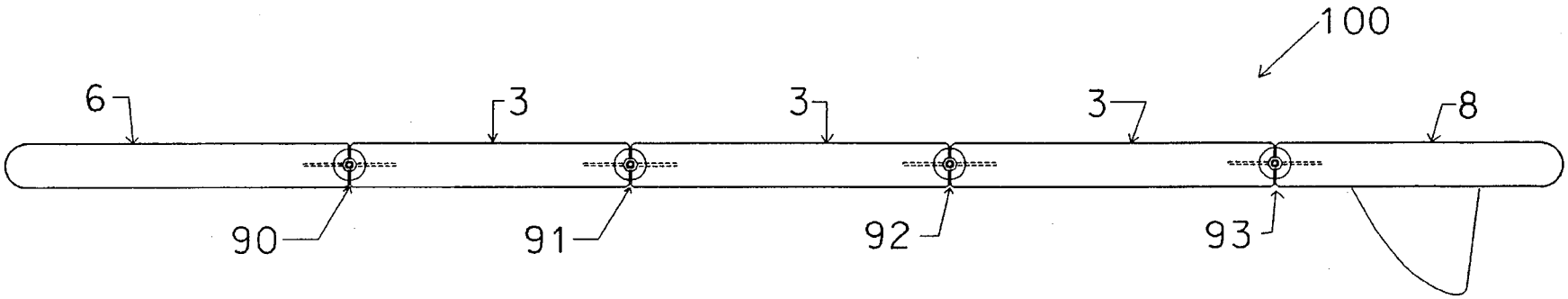

In FIGS. 1 and 2, a surfboard 100 extends longitudinally and has multiple sections, as shown. These include fore and aft sections 6 and 8, and three like intermediate sections 3. Joints or splits are formed at 90, 91, 92, and 93, and extend laterally between opposite edges 80 and 81 of 6; 82 and 83 of each of 3; and 84 and 85 of 8. Pins and anchors, at the splits, releasably interconnect the sections, as will be disclosed.

Figure 11:
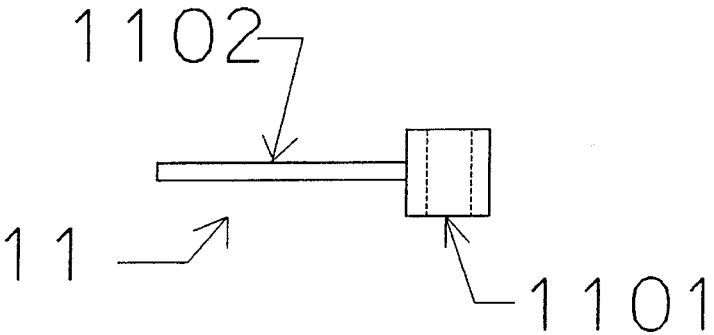
FIGS. 11 and 12 are plan views and elevational views, respectively, of a link means.
Figure 12:
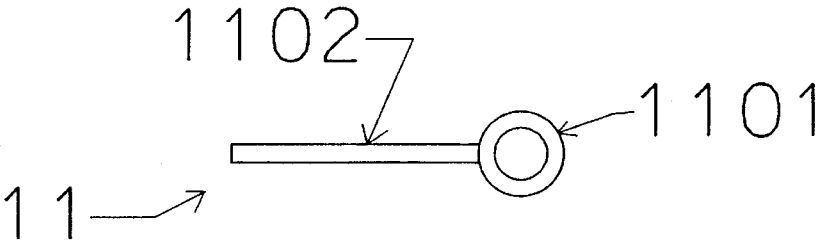

Referring to FIGS. 11 and 12, a link means includes a short link tube 1101, and a section anchor 1102, providing an anchoring means by which the link means can be anchored to any section of the improved surfboard. The drawings show a nail-type section anchor. The link tube is on one end of the section anchor.

Figure 13:
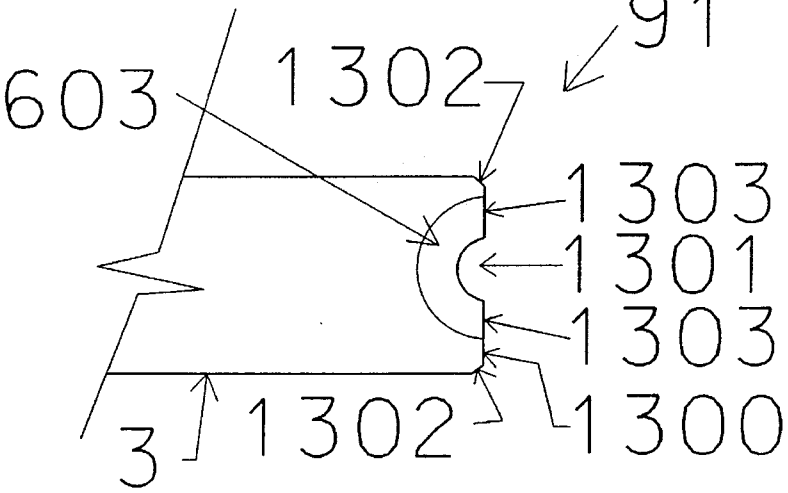
FIG. 13 is an enlarged elevation view of a joint end or a joint front.

Referring to FIG. 13, at a joint 91 there is a face 1300 at the end of a section 3 of a board. Sunk in the face is a fastening means slot 1301, and there are two surfaces 1303 and two beveled edges 1302. The fastening means slot extends medially along the face 1300. One end of each of the two surfaces 1303 intersects an edge of the fastening means slot. The other ends of the two surfaces 1303 intersect the two edges 1302. Surfaces 1303 on adjacent ends of two sections provide for abutting contact, when the board is assembled to block relative bending of the sections.

Figure 7:
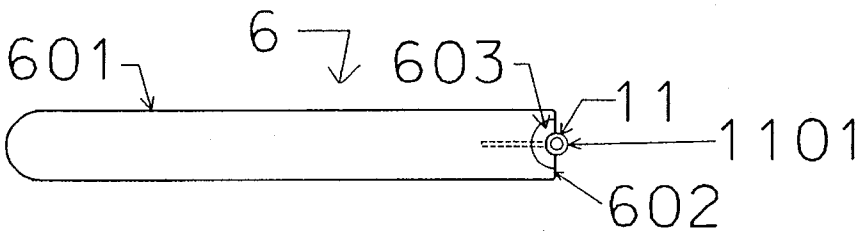
FIGS. 6 and 7 are plan views and elevational views, respectively, of the nose section of the improved surfboard.
Figure 6:
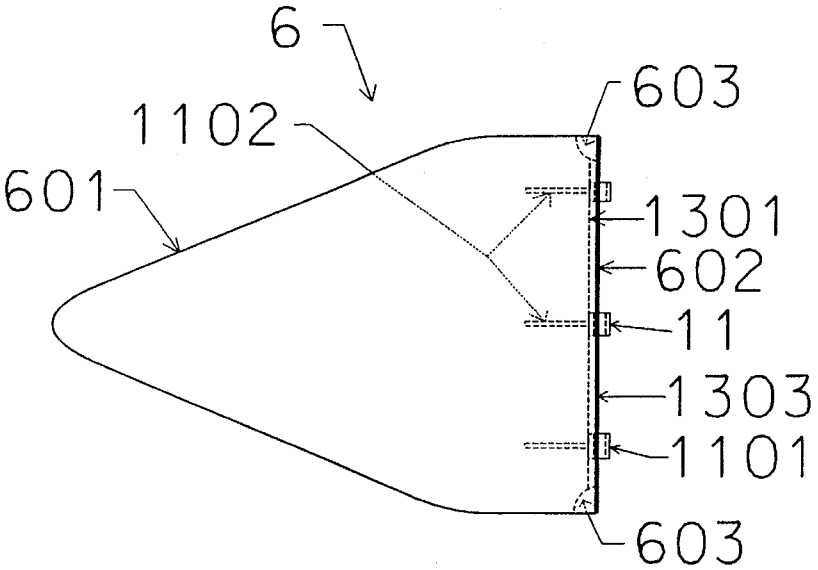

Referring to FIGS. 6 and 7, a nose section 6 consists of a nose board 601, a joint end 602, a pair of nut-washer receiving relieved areas 603 adjacent lateral ends of the joint, and three link means 11. The nose board has a relatively sharp front.

Referring to FIG. 13, the edge view of the joint end was described previously. The nut-washer receiving areas are on the side walls of the nose board. As seen in FIG. 6, the section anchors 1102 of the link means are anchored onto the nose board along the fastening means slot of the joint end. The centers of the link tubes 1101 are in lateral alignment and just slightly protruding from the lateral plane of the two surfaces 1303 of the joint end.

Figure 9:
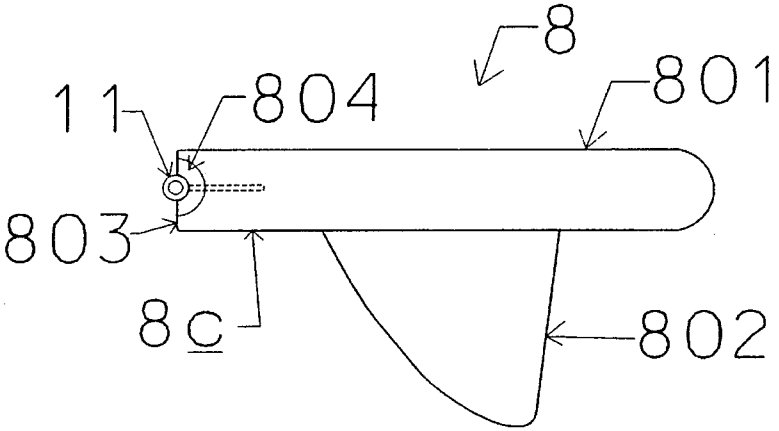
FIGS. 8 and 9 are plan views and elevational views, respectively, of the tail section of the improved surfboard.
Figure 8:
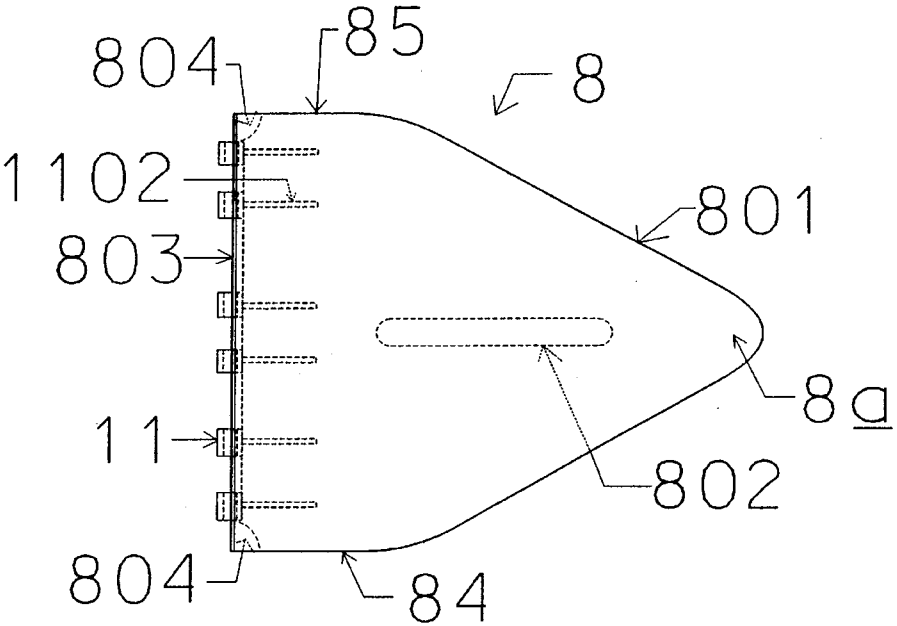

Referring to FIGS. 8 and 9, a tail section 8 comprises a tail board 801, a downwardly protruding fin 802, a joint front end 803 of the board 801, a pair of nut-washer, receiving-end areas 804, and a number of (i.e., six) of the link means 11, as shown. The tail board is a board with a relatively sharp or tapering end **8*a*. The nut-washer depressed areas 804 are located at the laterally spaced side walls 84 and 85** of the tail board.

The link means 11 was described earlier. The section anchor 1102 of the link means is anchored onto the tail board along the fastening means slot (such as slot 1301 at the joint front. The centers of the link tubes are in alignment and just slightly protruding from the two surfaces 1303 of the joint front. The fin 802 extends below the broad, flat, lower face **8*c*** of the tail board.

Figure 4:
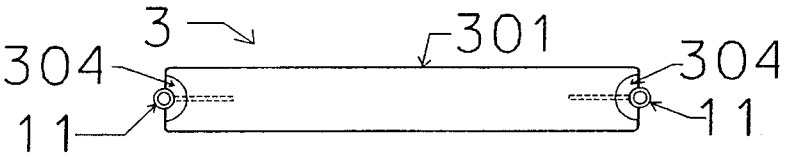
FIGS. 3 and 4 are plan views and elevational views, respectively, of a middle section of the improved surfboard.
Figure 3:
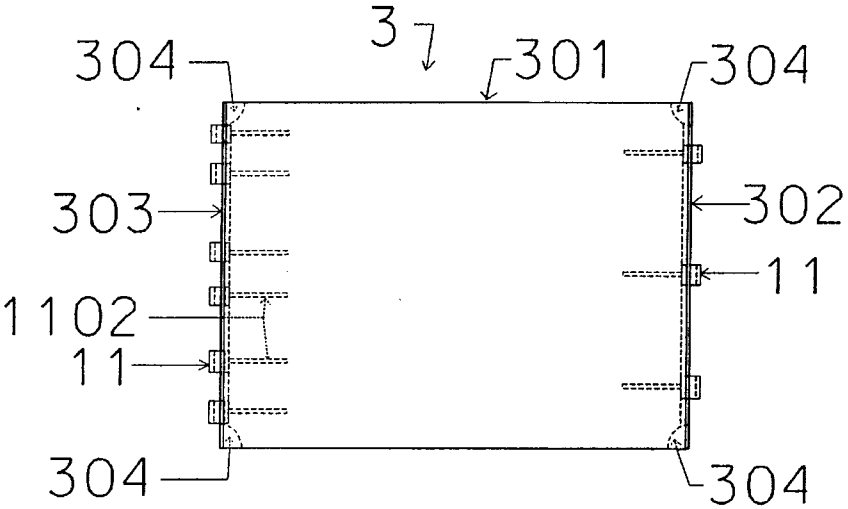

Referring to FIGS. 3 and 4, a middle section 3 comprises a middle board 301, a joint rear end 302, a joint front end 303, four nut-washer, receiving-relieved areas 304, and a number of the link means 11, as shown. The joint ends were described previously, as in FIG. 13. The areas 304 are located at the laterally spaced side walls of the middle board. The section anchors 1102 of the link means 11 penetrate into and anchor to the middle board along the fastening means slots 1301 of the joint end and the joint rear end. Anchoring may be as by adhesive bonding or by threads, or both. The centers of the link tubes are in lateral alignment and just slightly protruding from the two surfaces 1303 of the joint rear end and the joint front end.

Figure 5:
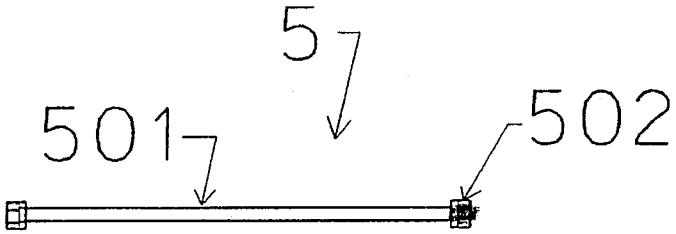
FIG. 5 is a schematic plan view of a bolt-nut-washer fastening means.

Referring to FIG. 5, a bolt-nut-washer fastening means 5 is typically a long bolt or pin 501 with washers and nut(s) 502.

Figure 10:
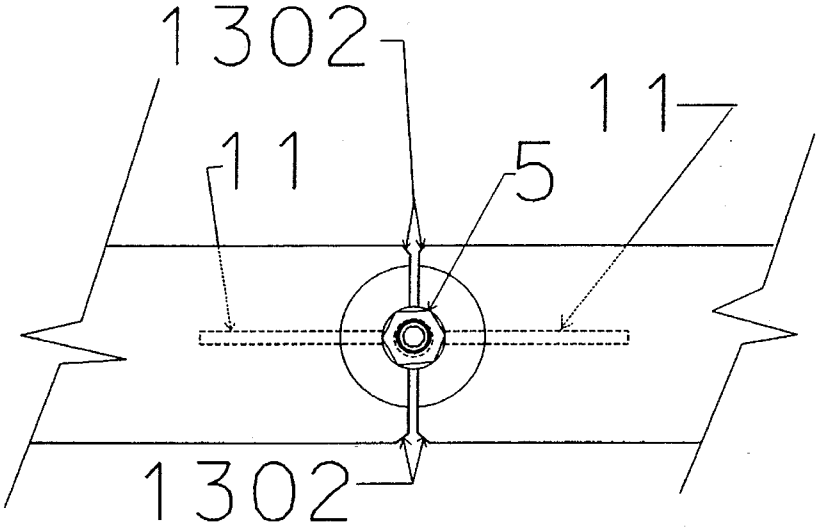
FIG. 10 is an elevation view which illustrates the connection details of the apparatus.

Referring to FIG. 10, when any two sections (a nose section and a middle section, a middle section and another middle section, or a middle section and an end section, etc.) are connected together, the joint ends are abutted against each other. At at least two places along the abutted joint, the link means of the two sequential board sections are so spaced that tubes 1101 of those links are in lateral endwise engagement, whereby there will be no lateral relative shifting between the two joined sections. See FIG. 1 in this regard.

Due to the existence of the fastening mean slots 1301, the bolt-nut-washer fastening means can penetrate and chain together the concentric link tubes. When two sequential board sections are thus joined together, the two surfaces 1303 of one section end will be very close to those of the other section end. Because of this, the two joined sections can be bent longitudinally by only a very small amount, i.e., a negligible angle. The two registered C-shaped relieved areas of the two joined sections will form an annularly relieved area in which the bolt head, and washer, and/or the washer, can seat. The length of the bolt is selected that no part of it will protrude from the joined sections.

Referring to FIGS. 1 and 2, multiple of the described-like sections 3 can be connected together to form a surfboard. The surfer can select the adequate number of sections desired for any selected buoyancy. The invented surfboard can be quickly disassembled by simply removing the bolt-nut-washer fastening means and separating the board sections.

The foregoing is considered as illustrative only of the principles of the invention. Furthermore, since numerous modifications and changes will readily occur to those skilled in the art, it is not desired to limit the invention to the exact construction and operation shown and described; and accordingly, all suitable modifications and equivalents may be resorted to, falling within the scope of the invention as claimed.

I claim:

1. In a surfboard assembly, the combination comprising a) said surfboard being longitudinally elongated, and including a longitudinal sequence of sections, there being a lateral split between sequential sections, b) and releasable attachment means rigidly interconnecting the sequential sections at said splits, c) said sequential sections having substantially flush upper surfaces and substantially flush lower surfaces, and said attachment means confined between the levels of said upper and lower surfaces, d) said attachment means including:

i) connecting structure penetrating longitudinally into said sequential sections and including loops at said splits, and ii) connection pins inserted laterally through said loops at said splits, the pins being withdrawable laterally from said loops, e) said connecting structure including anchors penetrating longitudinally into said sequential sections, each anchor integral with a loop, f) said sequential sections having generally longitudinally extending edges which are laterally spaced apart, said pins extending laterally between said edges, each pin having shoulders at opposite ends thereof to engage the sections proximate said laterally spaced edges, for retaining the pin in inserted position, g) the sequential sections having longitudinally abutting surfaces at said split, h) the sequential section edges being recessed to form C-shaped recess sections which together for a circular recess, the pin shoulders received in said circular recess.

2. The combination of claim 1 wherein there are at least four of said sections in a longitudinal sequence.

3. The combination of claim 1 wherein there are at least three of said splits.

4. The combination of claim 1 wherein said loops comprise tubes, there being at least one tube associated with one section in endwise engagement with a tube associated with the next in sequence section, whereby said sections are blocked against lateral relative shifting.

5. The combination of claim 1 wherein there is forwardmost section tapering forwardly and a rearwardmost section tapering rearwardly.

6. The combination of claim 5 including a fin integral with the rearwardmost section and protruding from the plane thereof.

7. The combination of claim 5 wherein there are intermediate sections between said forwardmost section and said rearwardmost section, each intermediate section having greater length than width.

8. The combination of claim 7 wherein said abutting surfaces have sufficient width to block relative pivoting of the sections.

* * * * *

UNITED STATES PATENT AND TRADEMARK OFFICE

CERTIFICATE OF CORRECTION

PATENT NO. : 5,476,403

DATED : Dec. 19, 1995

INVENTOR(S) : Chih-Yu Hsia

It is certified that error appears in the above-indentified patent and that said Letters Patent is hereby corrected as shown below:

On summary page after Inventor: "Chin-Yu Hsia" should read --Chih-Yu Hsia--

Signed and Sealed this

Fifth Day of March, 1996

*Attest:*

*Attesting Officer*

BRUCE LEHMAN

*Commissioner of Patents and Trademarks*